US011519691B2

(12) United States Patent
Jacobson

(10) Patent No.: US 11,519,691 B2
(45) Date of Patent: Dec. 6, 2022

(54) FIREARM MULTI-TOOL AND SHEATH

(71) Applicant: New Revo Brand Group, LLC, Plymouth, MN (US)

(72) Inventor: Ryan Jacobson, Minneapolis, MN (US)

(73) Assignee: NEW REVO BRAND GROUP, LLC, Plymouth, MN (US)

( * ) Notice: Subject to any disclaimer, the term of this patent is extended or adjusted under 35 U.S.C. 154(b) by 193 days.

(21) Appl. No.: 17/014,674

(22) Filed: Sep. 8, 2020

(65) Prior Publication Data

US 2022/0074703 A1 Mar. 10, 2022

(51) Int. Cl.

| | |
|---|---|
| ***F41C 27/00*** | (2006.01) |
| ***B25B 23/00*** | (2006.01) |
| ***B25G 1/08*** | (2006.01) |
| ***B25F 1/04*** | (2006.01) |

(52) U.S. Cl.

CPC ..... *F41C 27/00* (2013.01); *B25B 23/0035* (2013.01); *B25F 1/04* (2013.01); *B25G 1/085* (2013.01)

(58) Field of Classification Search

CPC ..... F41C 27/00; B25B 23/0035; B25B 15/00; B25B 1/08; B25F 1/04; B25F 1/02; B25G 1/085; B26B 5/001; B26B 1/00–06; B26B 1/10; A45F 5/14; B25H 3/003

USPC ..... 7/120; 81/490; 30/153, 155–161; 224/234, 904; 206/234

See application file for complete search history.

(56) References Cited

U.S. PATENT DOCUMENTS

| | | | | |
|---|---|---|---|---|
| 6,352,010 | B1 * | 3/2002 | Giarritta | B26B 11/00 81/439 |
| 6,916,106 | B2 * | 7/2005 | Xingguo | B25G 1/043 362/120 |
| 8,166,850 | B2 * | 5/2012 | Caniparoli | B25G 1/085 7/137 |
| 9,701,004 | B2 * | 7/2017 | Hardinge | B25F 1/04 |
| 10,265,841 | B2 * | 4/2019 | Rauwerdink | B26B 11/001 |
| 10,464,199 | B2 * | 11/2019 | Hardinge | B25F 1/04 |
| 2011/0314719 | A1 * | 12/2011 | Tripp | B25B 13/56 42/108 |
| 2017/0209999 | A1 * | 7/2017 | Keng | B26B 11/001 |
| 2020/0171642 | A1 * | 6/2020 | Newman | B25F 1/04 |

OTHER PUBLICATIONS

The AR15 Scraper. Website. Retrieved Dec. 2020. https://www.realavid.com/product/the-ar15-scraper/.

The Pistol Tool. Website. Retrieved Dec. 2020. https://www.realavid.com/product/the-pistol-tool/.

* cited by examiner

*Primary Examiner* — David B. Thomas

*Assistant Examiner* — Jason Khalil Hawkins

(74) *Attorney, Agent, or Firm* — Grumbles Law PLLC; Brittany Haanan

(57) ABSTRACT

A firearm multi-tool and sheath can include a multi-tool having a plurality of tools that are pivotally connected to a frame of the multi-tool; and a sheath for storing the multi-tool. The sheath can include a frame, a spring-loaded bit driver pivotally connected to the frame, a release lever structured and configured to engage with the spring-loaded bit driver to releasably lock the bit driver in place, and bit set storage, wherein the bit set storage is inset in the frame and is structured and configured to house a plurality of bits.

20 Claims, 6 Drawing Sheets

FIREARM MULTI-TOOL AND SHEATH

FIELD OF THE INVENTION

This disclosure relates to firearm maintenance aids, and more particularly, relates to a multi-tool and sheath for firearm maintenance.

BACKGROUND OF THE INVENTION

During maintenance activities, firearms such as pistols and rifles (or sub-components thereof) are often opened and disassembled. This enables an armorer to more thoroughly perform maintenance tasks and can help the armorer gain access to hard-to-reach pieces and components. Multi-tools that assist with disassembly and cleaning are known in the field. However, due to their compact size, they can easily be misplaced or lost. Additionally, often times a bit driver and specific bits are required to assist with disassembly, cleaning, maintenance, and assembly. It would be desirable to provide a multi-tool that can facilitate disassembly, cleaning, maintenance, and assembly of a firearm, that can decrease the probability of being misplaced or lost, and that can store commonly used bits as well as a bit driver.

SUMMARY

This disclosure relates to firearm maintenance aids, and more particularly, relates to multi-tools for firearm maintenance. In one aspect, the disclosure provides a firearm multi-tool and sheath that can include a multi-tool and a sheath for storing the multi-tool, wherein the sheath can include a frame, a bit driver pivotally connected to the frame, and bit set storage, wherein the bit set storage is inset in the frame and is structured and configured to house a plurality of bits.

In some embodiments, the bit driver can be magnetic and spring-loaded. Further, the bit driver, in a first orientation or configuration, can be engaged with a release lever and can be structured and configured to contain the multi-tool in the sheath. In addition, the bit driver, in a second orientation or configuration, can pivot outward away from the release lever to release the multi-tool and function as a bit driver.

In some embodiments, the bit set storage can be magnetic. Additionally, the bit set storage can be interior to the frame. And in some cases, the bit set storage can include a plurality of cavities, wherein each cavity can be structured and configured to store one or more bits from the plurality of bits. In some embodiments, the sheath further includes a clip on an external portion of the frame. The clip can be a MOLLE compatible belt clip.

In some embodiments, the frame can be open on a first side and can have walls on at least portions of a top, bottom, front, back, and second side. Further, the walls on the front, top, and bottom can be partial walls and/or the walls on the back and second side are complete walls.

In some embodiments, the multi-tool can include a plurality of tools that are pivotally connected to a frame of the multi-tool. Further, the multi-tool can include at least one of a tap hammer on a side of the frame and a bushing wrench inset into the frame. In some cases, the plurality of tools can include at least one of a blade, a bolt override, a takedown punch, a firing pin retaining pin puller, at least one bolt carrier scraper, a carrier scraper, and a firing pin scraper. In other cases, the plurality of tools can include at least one of a knife blade, a plurality of hex keys, a pin punch, a carbon scraper, a metal file, a pick, nut wrenches, and a bottle opener.

In another aspect, the disclosure provides a firearm multi-tool and sheath that can include a multi-tool having a plurality of tools that are pivotally connected to a frame of the multi-tool; and a sheath for storing the multi-tool. The sheath can include a frame, a spring-loaded bit driver pivotally connected to the frame, a release lever structured and configured to engage with the spring-loaded bit driver to releasably lock the bit driver in place, and bit set storage, wherein the bit set storage can be inset in the frame and can be structured and configured to house a plurality of bits.

In another aspect, the disclosure provides a method of using a sheath as a bit driver, the method including the steps of engaging a release lever on a frame of a sheath to release a spring-loaded bit driver, wherein the bit driver pivots away from the release lever and the frame acts as a handle for the bit driver; removing a multi-tool from inside the frame of the sheath; removing a bit from bit set storage that is inset in the frame of the sheath; and inserting the bit into the bit driver, wherein the bit driver magnetically engages the bit. In some cases, the bit set storage can be magnetic.

In some embodiments, the method can further include the steps of removing the bit from the bit driver; securing the bit into the bit storage; inserting the multi-tool into the frame of the sheath; and pivoting the bit driver toward the release lever and engaging a cavity of the bit driver with an engagement portion of the release lever.

The above summary is not intended to describe each and every example or every implementation of the disclosure. The description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
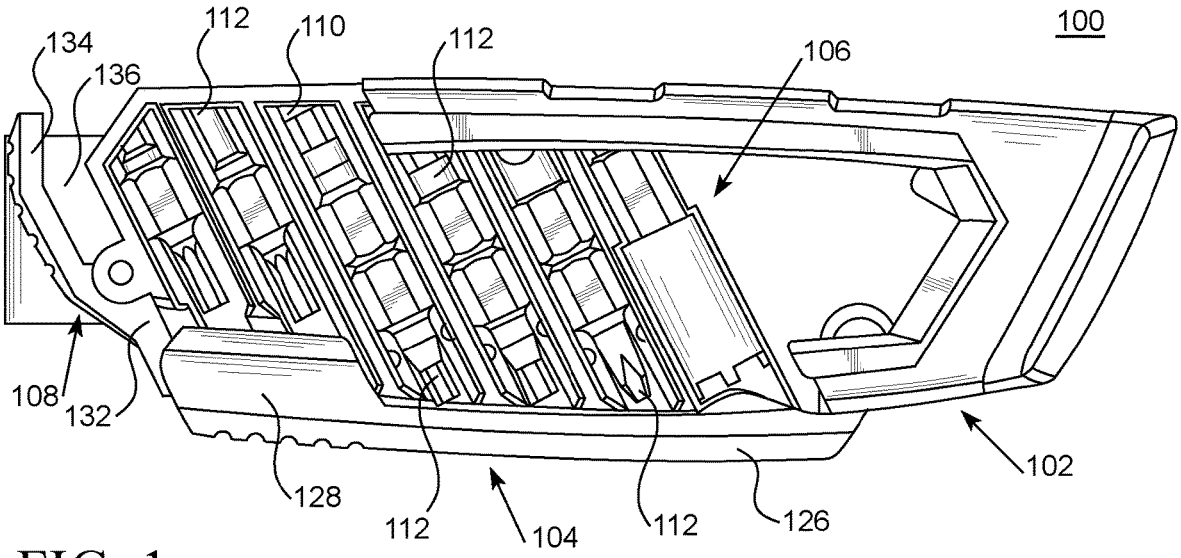
FIG. 1 is a front view of a sheath of a firearm multi-tool and sheath system.

The present disclosure relates to firearm maintenance aids, and more particularly, relates to multi-tools for firearm maintenance. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Figure 7:
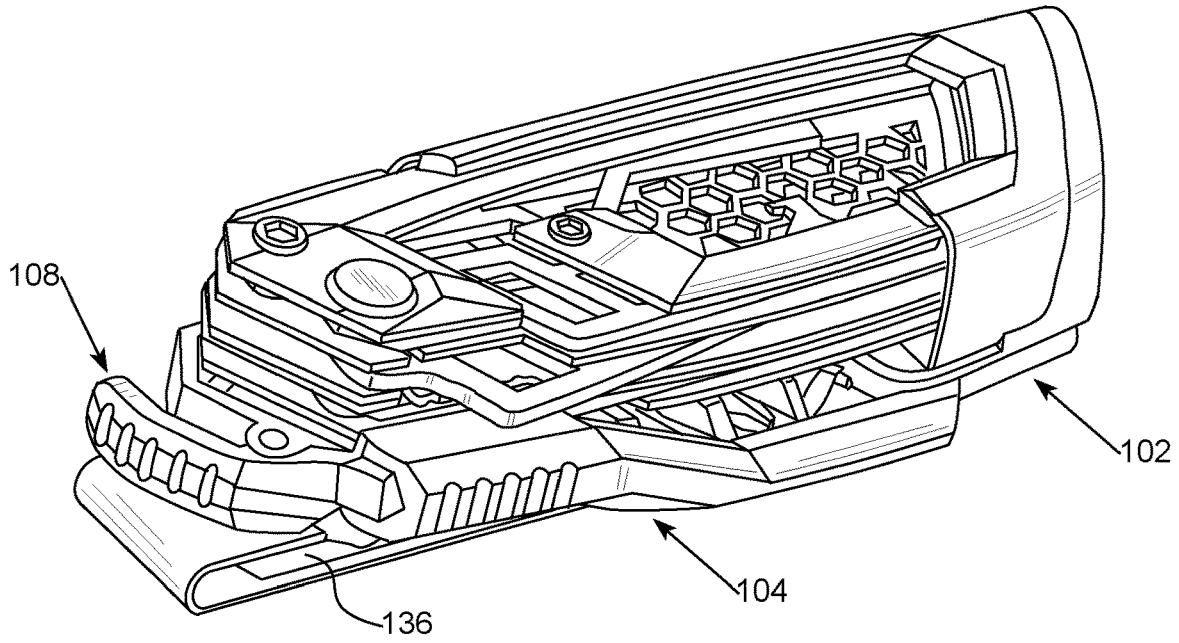
FIG. 7 is a perspective bottom view of the firearm multi-tool and sheath system with a multi-tool engaged in the sheath.

FIG. 7 is a perspective view of an illustrative example of a firearm multi-tool and sheath. Sheath 100 can include frame 102, bit driver 104, and bit set storage 106. Frame 102 can include release driver 108 engaged with bit driver 104, as illustrated in FIG. 1. Bit driver 104 can be spring-loaded and/or magnetic. Bit set storage 106 can be inset into the frame and structured and configured to house a plurality of bits. Multi-tool 200 can be structured and configured to fit within sheath 100 and can include a plurality of tools that are pivotally connected to multi-tool frame 202.

Figure 2:
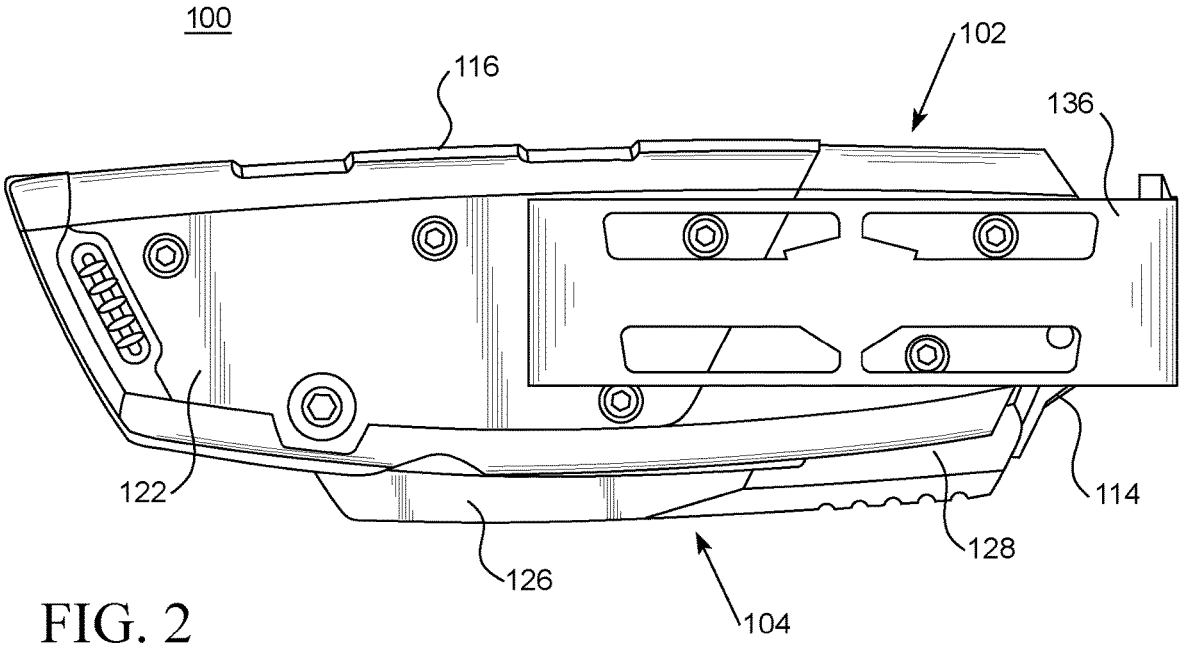
FIG. 2 is a back view of the sheath.
Figure 3:
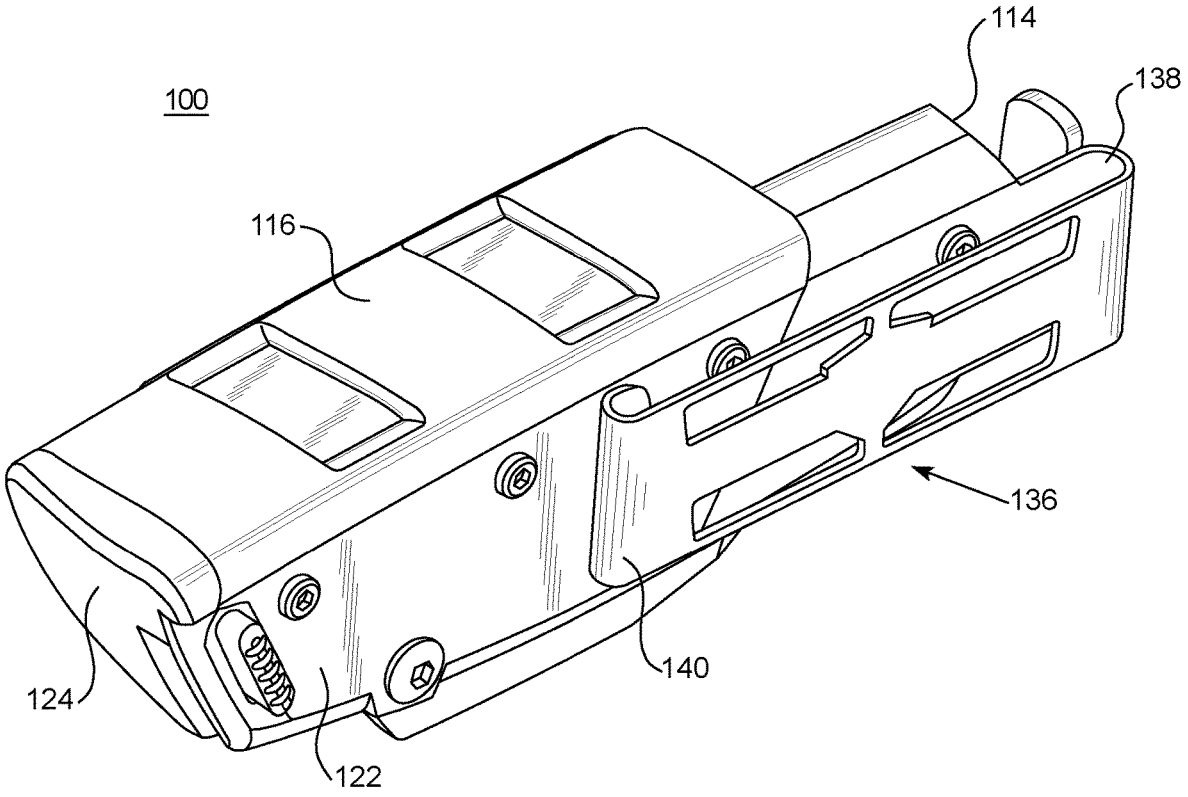
FIG. 3 is a perspective top view of the sheath.
Figure 4:
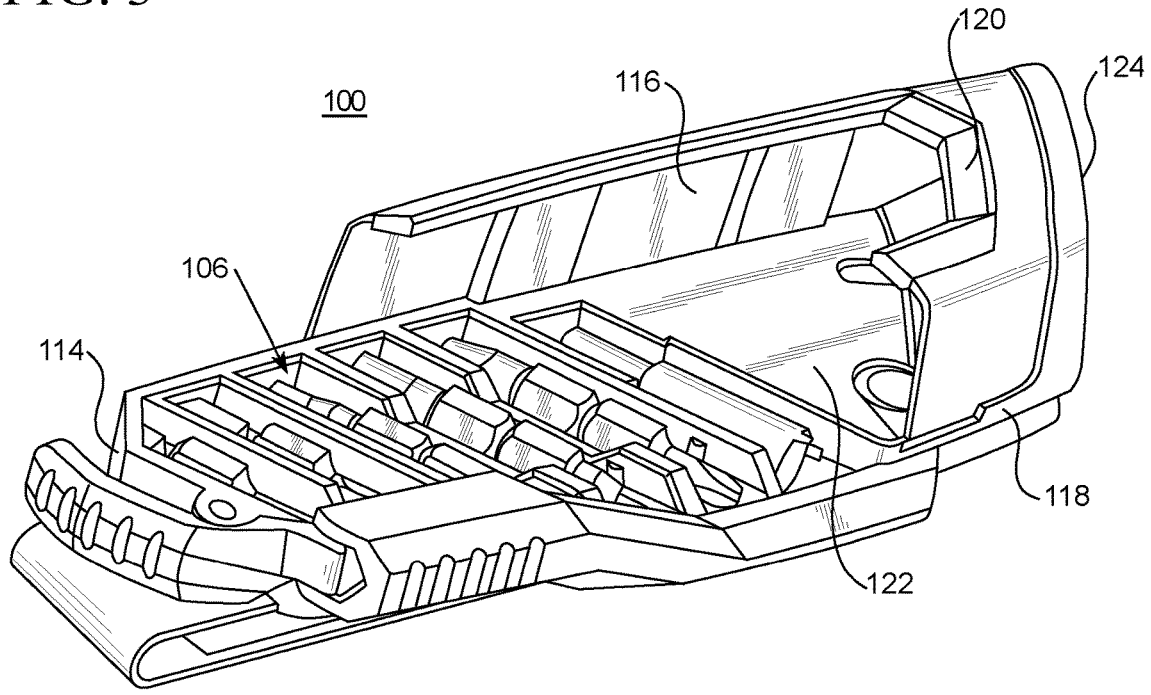
FIG. 4 is a perspective bottom view of the sheath with a bit driver in an engaged position with a release lever.
Figure 5:
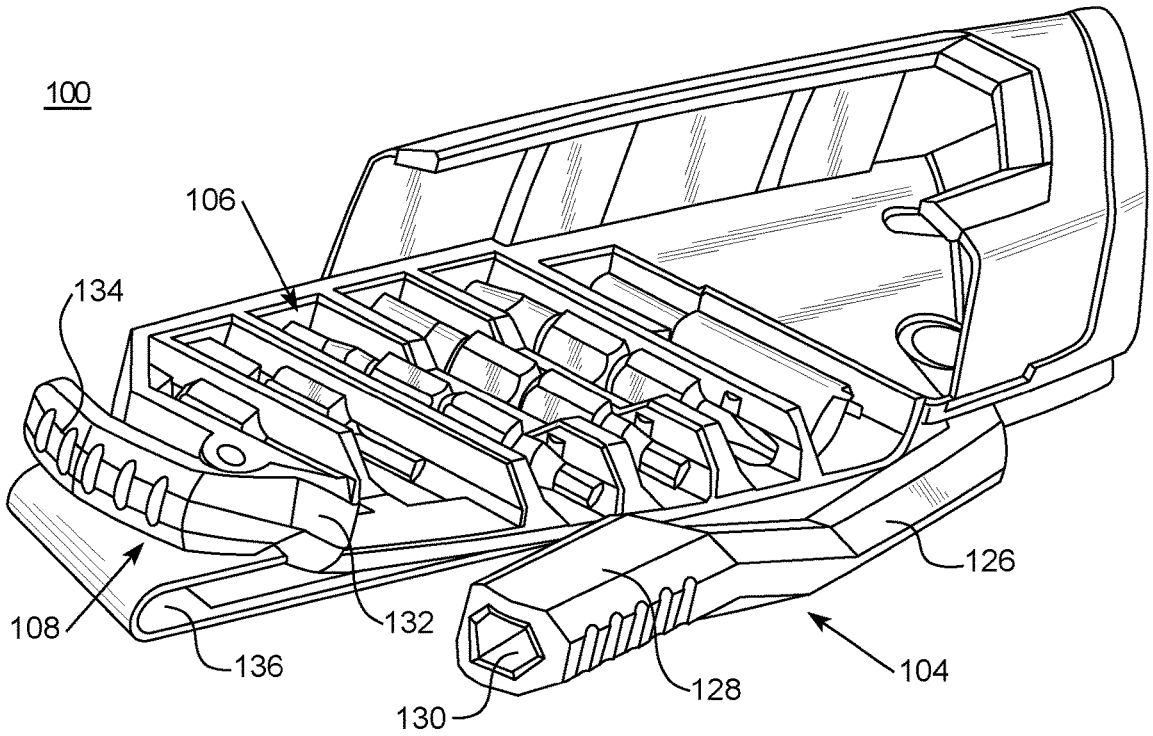
FIG. 5 is a perspective bottom view of the sheath with the bit driver in a disengaged position with the release lever.
Figure 6:
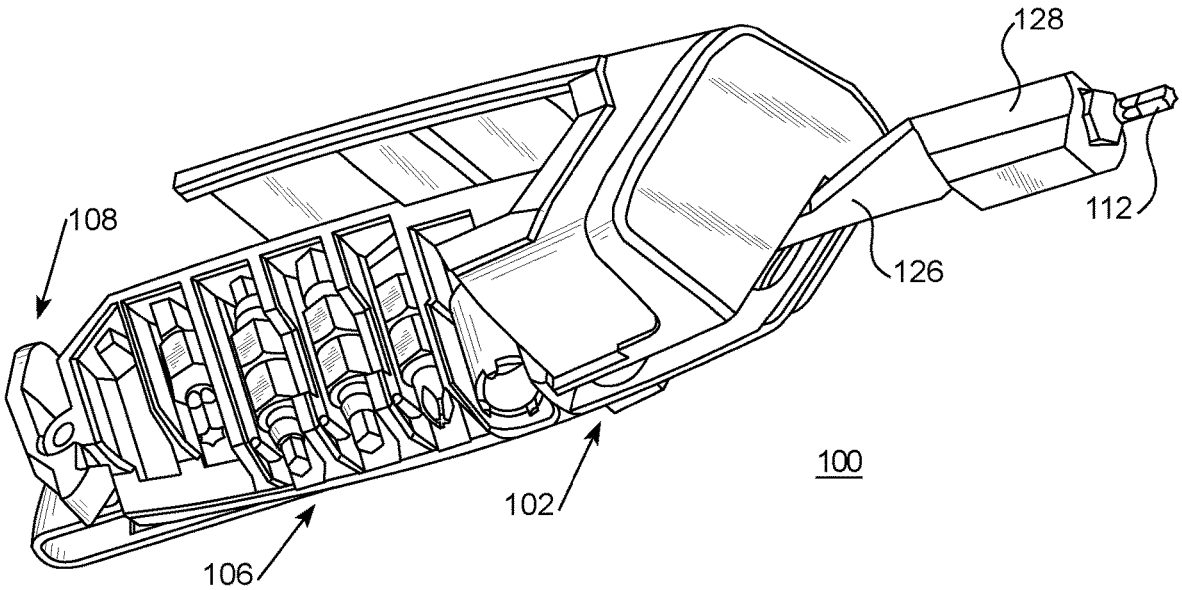
FIG. 6 is a perspective side view of the sheath with the bit driver pivoted away from a frame of the sheath.
Figure 8:
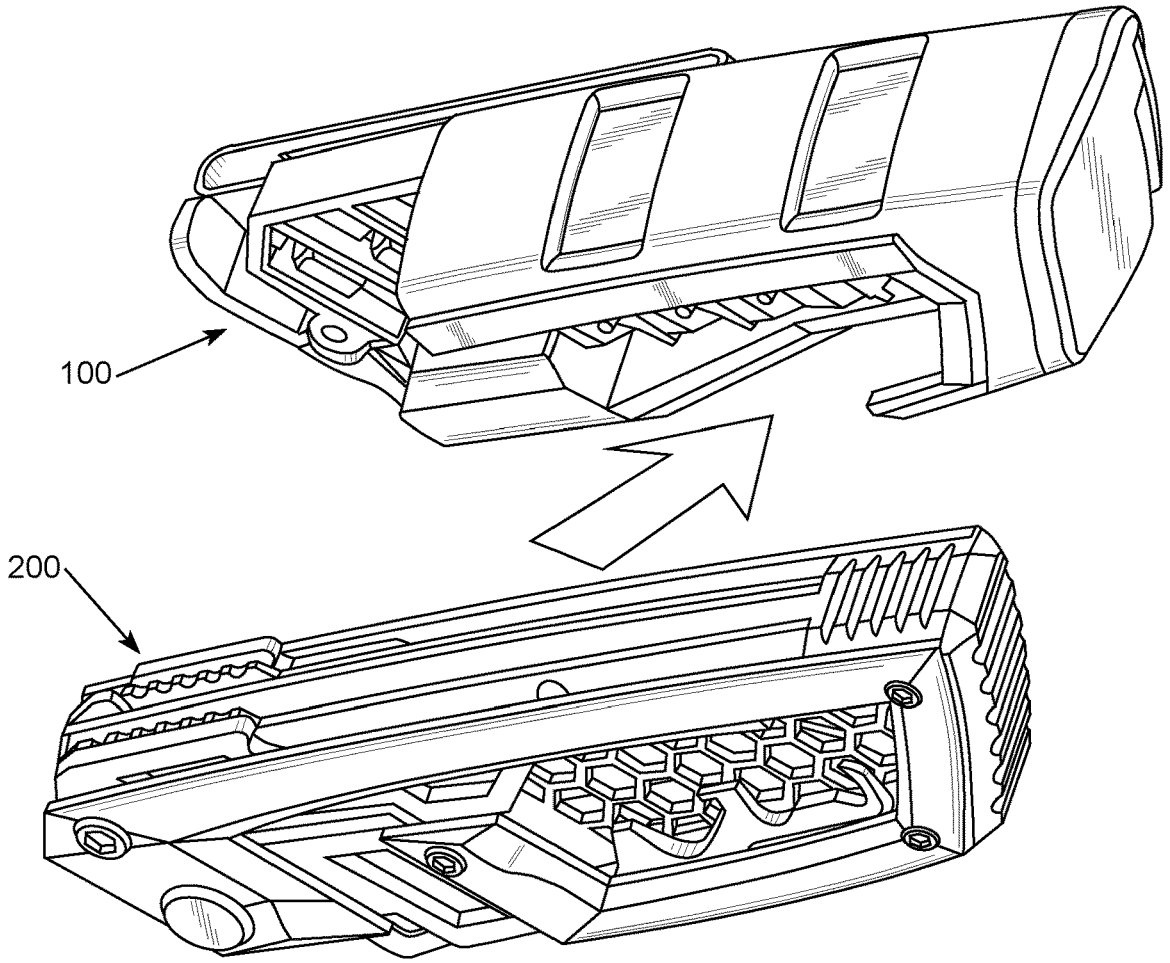
FIG. 8 is a schematic perspective top view of the firearm multi-tool and sheath system that indicates movement of a multi-tool into the sheath.
Figure 9:
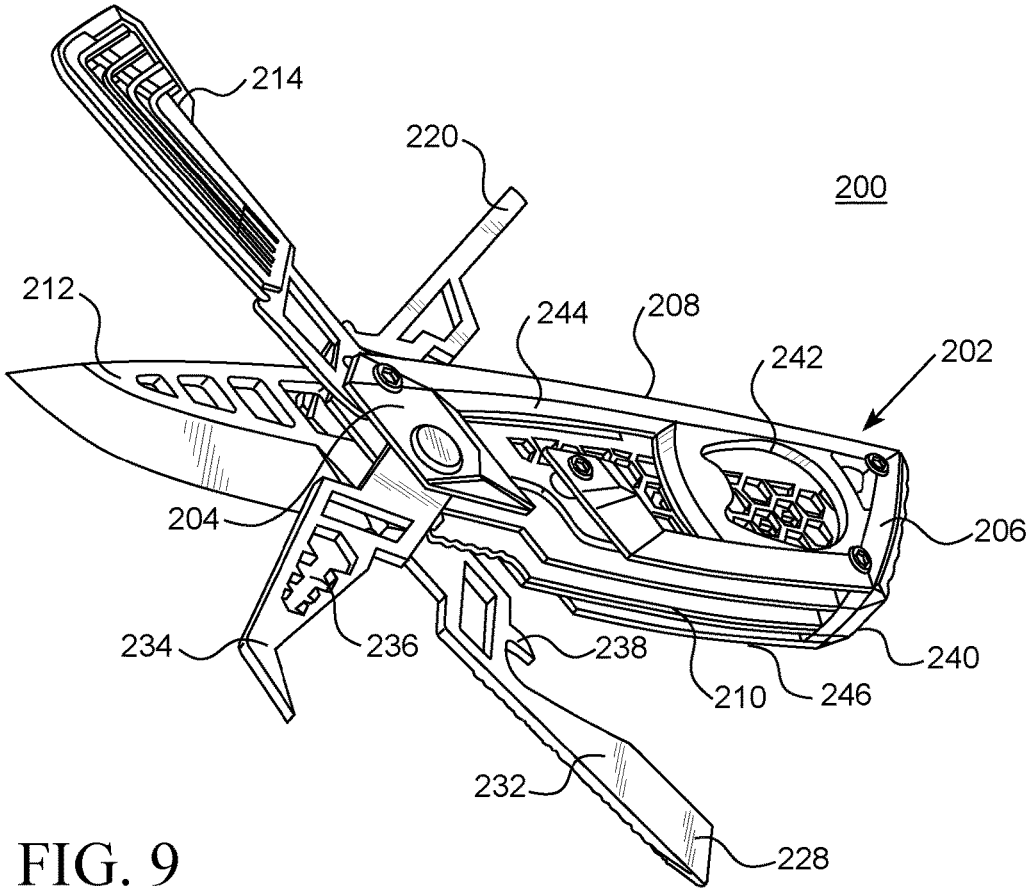
FIG. 9 is a bottom perspective view of a first example of a firearm multi-tool of the firearm multi-tool and sheath system.
Figure 10:
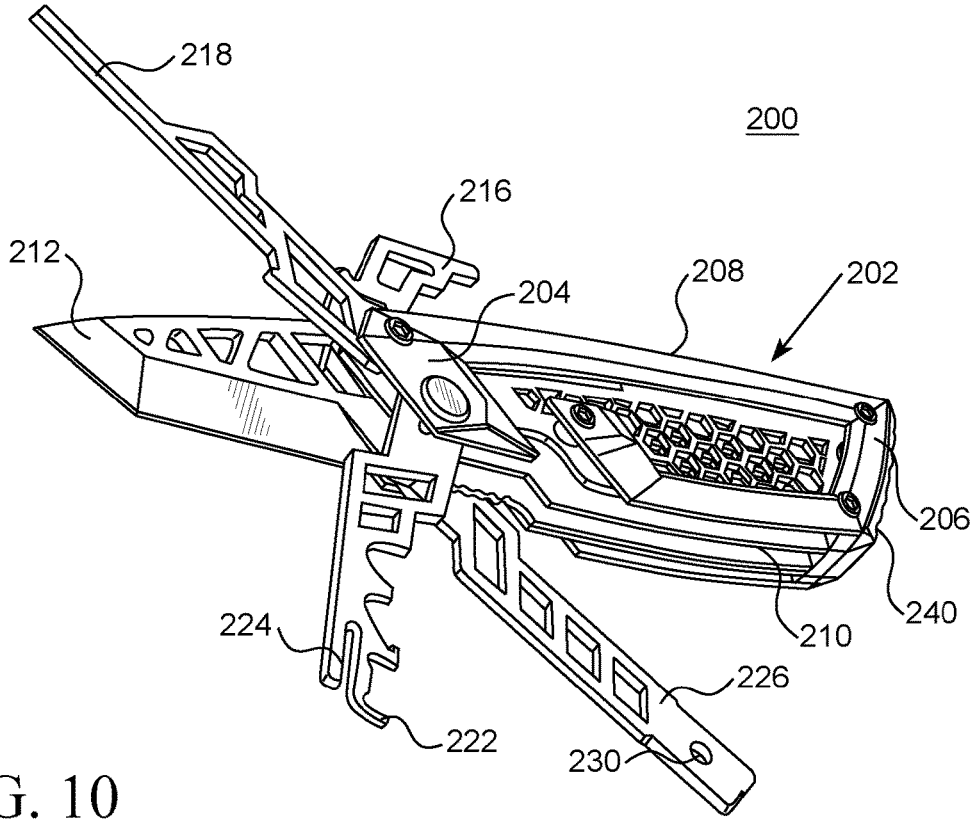
FIG. 10 is a bottom perspective view of a second example of a firearm multi-tool of the firearm multi-tool and sheath system.
Figure 11:
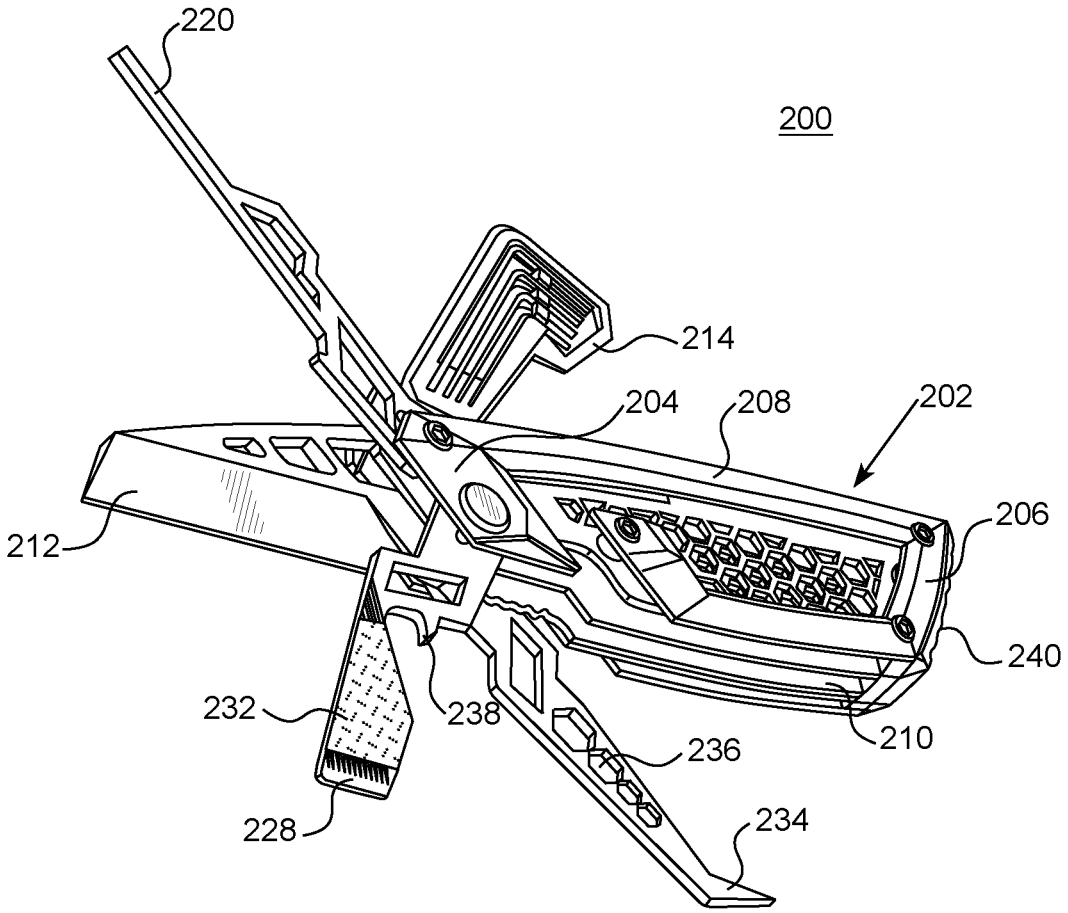
FIG. 11 is a bottom perspective view of a third example of a firearm multi-tool of the firearm multi-tool and sheath system.

Additional views of sheath 100 and multi-tool 200 are provided. FIG. 1 is a front view of the sheath of the firearm multi-tool and sheath system. FIG. 2 is a back view of the sheath. FIG. 3 is a perspective top view of the sheath. FIG. 4 is a perspective bottom view of the sheath with the bit driver in an engaged position with the release lever. FIG. 5 is a perspective bottom view of the sheath with the bit driver in a disengaged position with the release lever. FIG. 6 is a perspective side view of the sheath with the bit driver pivoted away from a frame of the sheath. FIG. 8 is a schematic perspective top view of the firearm multi-tool and sheath system that indicates movement of a multi-tool into the sheath. FIG. 9 is a bottom perspective view of a first example of a firearm multi-tool of the firearm multi-tool and sheath system. FIG. 10 is a bottom perspective view of a second example of a firearm multi-tool. FIG. 11 is a bottom perspective view of a third example of a firearm multi-tool.

Sheath 100 and multi-tool 200 can generally be comprised of rigid materials such that the sheath and multi-tool (with the exception of their pivotable components) cannot be folded, bent, or otherwise forced out of shape. Examples of materials used for sheath 100 and multi-tool 200 include, but are not limited to, metal (for example, aluminum, steel, iron, brass, copper, etc.), plastic (for example, high-density polyethylene, polyvinyl chloride, polypropylene, other thermoplastic polymers, etc.), high durometer rubber, and combinations thereof.

As mentioned above, sheath 100 can include frame 102, bit driver 104, and bit set storage 106. Frame 102 can at least partially encompass multi-tool 200 such that the multi-tool can be stored inside of the frame of the sheath, as illustrated in FIG. 7. Bit driver 104 can be pivotally connected on frame 102, as illustrated in FIGS. 5 and 6, and can engage with release lever 108 of the frame, as illustrated in FIG. 4, such that the bit driver can releasably lock multi-tool 200 inside the frame. Bit set storage 106 can include a plurality of cavities 110, wherein each cavity can be structured and configured to store one or more bits 112, as illustrated in FIG. 1. The term "bits" as used throughout this disclosure can refer to hex bits, flat bits, slotted bits, Phillips bits, sight adjusters, bushing tools, or any other type of similar implement.

As illustrated in FIG. 4, frame 102 of sheath 100 can be open on a first side 114 and can have at least partial sidewalls on a top 116, bottom 118, front 120, back 122, and second side 124. The sidewalls of frame 102 can be separate from the frame or can be one continuous piece. Further, some of the sidewalls may be separate pieces from frame 102 and some may be part of the frame's continuous piece.

In some embodiments, the sidewalls on the front 120, top 116, and bottom 118 are partial walls and the sidewalls on the back 122 and second side 124 are complete walls. Therefore, multi-tool 200 can be slid into frame 102 from the first side toward the second side, as illustrated in FIG. 8, and can be held in place within the frame by the top sidewall 116, bottom sidewall 118, second side sidewall 124, and back 122.

In some cases, the sidewalls of frame 102 on the top 116, second side 124, and bottom 118 can extend away from the back 122 in a direction that is about perpendicular to the back. The top 116, second side 124, and bottom 118 sidewalls can also incorporate portions that extend in a direction that are about parallel to the back 122 of frame 102, wherein the perpendicular portion is located between the back and the parallel portion, as illustrated in FIG. 4. This parallel portion can also be considered the partial sidewall for the front 120 of frame 102. In this configuration, the inner surfaces of the top 116, second side 124, bottom 118, back 122, and front 120 sidewalls can partially surround and support a side of multi-tool 200 on five surfaces of the multi-tool, as illustrated in FIG. 7.

Bit driver 104 of sheath 100 can, in some embodiments, be pivotally connected on frame 102 at a point on, for example, the bottom of the frame, as illustrated in FIG. 5. Alternatively, bit driver 104 can be connected on a side of frame 102, on a corner of the frame, on a top of the frame, or on one of the sidewalls of the frame. Regardless of where bit driver 104 attaches, it can be structured and configured to complement sidewalls of frame 102 such that when multi-tool 200 is placed into sheath 100, the bit driver can help lock the multi-tool in place. As described in more detail below, bit driver 104 can engage with release lever 108 to securely lock multi-tool 200 in sheath 100.

In some embodiments, bit driver 104 can be comprised of an arm 126 and a head 128, wherein a first end of the arm can pivotally connect to frame 102 and a second end of the arm can connect to the head. As illustrated in FIG. 6, the pivot connection for bit driver 104 can be nearer to the second end of frame 102 without being at the second end, such that when the bit driver rotates into an active configuration (also referred to below as a second orientation or configuration), a portion of the arm overlaps with the frame. However, this is not necessary and, as mentioned above, the pivot connection for bit driver 104 may be located at the second end of frame 102 or even on a corner or the second side.

The head of bit driver 104 can be magnetic and can include cavity 130 on its end that is structured and configured to receive a bit 112. More specifically, cavity 130 can have a specific shape (for example, hexagonal) that corresponds to the shape of the base of bit 112 so that when the bit is inserted into the cavity, it cannot freely rotate. Further, head 128 and/or cavity 130 of the head can magnetically engage bit 112 such that when the head is held upside down with the cavity facing downward, the bit will not fall out.

Cavity 130 of bit driver 104 can also be structured and configured to engage with release lever 108, such that a portion of the release lever (for example, a hook 132) can insert into the cavity and remain locked in place until the release lever is actively disengaged by a user. This mechanism is described in more detail below. In some embodiments, bit driver 104 can be spring-loaded such that when release lever 108 is actively disengaged and the bit driver is free to rotate from its first orientation/configuration, the spring can cause the bit driver to automatically rotate away from its current position and pivot, for example, up to 180 degrees in the opposite direction into a second orientation or configuration. In this second orientation/configuration, frame 102 of sheath 100 can act as a handle for bit 112 and bit driver 104.

In some embodiments, a plurality of bits 112 can be stored or housed in bit set storage 106 of sheath 100, and the bit set storage can be inset in frame 102. More specifically, bit set storage 106 can be inset in an interior face of frame 102, such that when multi-tool 200 is inserted into sheath 100, the bit set storage is positioned between the frame and the multi-tool. For example, as illustrated in FIGS. 1 and 4-6, bit set storage 106 can be inset into the interior face of the back 122 of frame 102.

To prevent bits 112 from inadvertently falling out of bit set storage 106, the bit set storage can be magnetic. In this manner, the bits can remain secured in bit set storage 106 regardless of the orientation of sheath 100 (for example, when the sheath is being used as a bit driver and therefore rotated and positioned with the bits facing partially or completely down) and the presence or absence of multi-tool 200, which could otherwise help keep bits secured in place.

In some embodiments, bit set storage 106 may further include a plurality of cavities 110. Each cavity may be structured and configured to store one or more bits from the plurality of bits, as illustrated in FIGS. 1 and 4-6. Cavities 110 may align next to each other along their lengths and may have lengths spanning from the top to the bottom of frame 102 (either at an angle, as illustrated, or approximately perpendicular to the top 116 and bottom 118 faces of the frame). In some cases, the lengths may span completely from the top 116 to the bottom 118 of frame 102, while in other cases, the lengths may span a partial distance from the top to the bottom of the frame.

The plurality of cavities of bit set storage 106 may be structured and configured to further help secure bits in bit set storage 106. For example, cavities 110 can be sized to be approximately the same diameter as, but slightly wider than, bits 112 such that the cavities can create a friction fit with the bits. Therefore, regardless of whether bit set storage 106 is magnetic, as mentioned above, bits 112 may be mechanically held in place in their respective cavities and prevented from inadvertently falling out of the bit set storage.

In addition to frame 102, bit driver 104, and bit set storage 106, sheath 100 can further include release lever 108. Release lever 108 can include an engagement portion 132 (for example, a hook), as mentioned above, and a lever portion 134 that is positioned opposite the engagement portion. Engagement portion 132 of release lever 108 can engage with the head of bit driver 104 when the bit driver is in a first orientation/configuration. Additionally, release lever 108 can be pivotally connected to frame 102 of sheath 100 near a central portion of the release lever, as illustrated in FIGS. 1 and 6. Therefore, when a user moves lever portion 134 in a first direction, release lever 108 can pivot along the pivot connection to frame 102 and the lever portion's movement in a first direction can correspondingly move the engagement portion 132 in a second direction, opposite the first direction, thereby disengaging the release lever from bit driver 104 and allowing the bit driver to pivot outward away from the release lever and into a second orientation/configuration where it can be used as a bit driver and can allow release of multi-tool 200 from sheath 100.

Further, release lever 108 can be spring-loaded such that when the user releases lever portion 134, the user is no longer pushing the lever portion against a spring and the spring can automatically move the lever portion and engagement portion 132 back into their original positions, therefore allowing the release lever to be moved back into an engaged configuration. For example, if a user pushes down on lever portion 134, the user may also be pushing against the spring and lifting the engagement portion 132 up out of cavity 130 of head 128 of bit driver 104, thereby disengaging release lever 108. When the user releases lever portion 134, the spring can push the lever portion back up into its starting position and, therefore, engagement portion 132 can move down either into cavity 130 of bit driver 104, as illustrated in FIGS. 1 and 4, or into a space where the cavity would be located if the bit driver was appropriately positioned next to release lever 108, as illustrated in FIGS. 5-6.

In some embodiments, sheath 100 can also include a clip 136 on an external portion of frame 102, as illustrated in FIGS. 2-3. Clip 136 can be a MOLLE compatible belt clip to enable a user to carry sheath 100 and multi-tool 200 easily on a belt, backpack, vest, or any other suspension-based system. More specifically, clip 136 can be located on a back of frame 102 and can be positioned near the first end 114 of the frame, as illustrated in FIG. 2. For example, as illustrated in FIG. 3, the solid end 138 of clip 136 that flexes to open the clip can be near the first end 114 of frame 102 and the open end 140 of the clip that opens to accept the belt or other suspension system can be more centrally located on the frame. Therefore, when a user clips sheath 100 onto the user's belt or other suspension system, the sidewalls of frame 102 in which multi-tool 200 sits are located in a bottommost position, and release lever 108 is located at a topmost position. This configuration is beneficial since multi-tool 200 is less likely to inadvertently fall out of sheath 100 if release lever 108 is accidentally disengaged and the locking mechanism of bit driver 104 and the release lever is released.

As mentioned above, another component of the firearm multi-tool and sheath can be multi-tool 200. In some embodiments, multi-tool 200 can include a plurality of tools that are pivotally connected to a frame 202 of the multi-tool. And in some embodiments, one or more of the plurality of tools may be part of, or embedded into, frame 202 of multi-tool. The tools can be specific to a type of firearm (for example, an AR-15, 1911, or pistol) or they can be tools that are generally useful for any type of firearm.

The shape of multi-tool 200 may be such that it corresponds to the interior space of sheath 100 to provide for a snug fit, as illustrated in FIG. 7. More specifically, it may be a three-dimensional quadrilateral with a long top and bottom and a short right and left side. In some embodiments, the plurality of tools that are pivotally connected to the frame 202 of multi-tool 200 may be connected all near a first side 204, as illustrated in FIGS. 9-11. This configuration enables the remaining portion of multi-tool 200 to be used as a handle when a tool is pivotally extended and in use. However, having all pivotally connected tools near one side is not necessary and the tools may be spread out along frame 202 in one or more additional areas (for example, some tools may be located on a second, opposite side 206 of the frame or along the top 208 or bottom 210 of the frame).

Some examples of tools that may be included in multi-tool 200 are a blade 212, a plurality of hex keys 214, a bolt override 216, a takedown punch 218, a pin punch 220, a firing pin retaining pin puller 222, at least one bolt carrier scraper 224, a carrier scraper 226, a carbon scraper 228, a firing pin scraper 230, a metal file 232, a pick 234, nut wrenches 236, and a bottle opener 238. Other tools that may be included are a tap hammer 240 and a bushing wrench 242. The tap hammer 240, in some embodiments, can be located on a side of multi-tool 200 that is opposite the side of the pivotally connected tools, as illustrated in FIGS. 9-11. The bushing wrench 242, in some embodiments, can be inset into the frame of multi-tool 200 such that it is located on a front 244 or back face 246 of the frame, as illustrated in FIG. 9.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

What is claimed is:

1. A multi-tool and sheath comprising:
a multi-tool; and
a sheath for storing the multi-tool, the sheath including
a frame,
a bit driver pivotally connected to the frame, and
bit set storage, wherein the bit set storage is inset in the frame and is structured and configured to house a plurality of bit,
wherein the bit driver, in a first orientation/configuration, is engaged with a release lever and is structured and configured to contain the multi-tool in the sheath.

2. The multi-tool and sheath of claim 1, wherein the bit driver is magnetic and spring-loaded.

3. The multi-tool and sheath of claim 1, wherein the bit driver, in a second orientation/configuration, pivots outward away from the release lever to release the multi-tool and function as a bit driver.

4. The multi-tool and sheath of claim 1, wherein the bit set storage is magnetic.

5. The multi-tool and sheath of claim 1, wherein the bit set storage is interior to the frame.

6. The multi-tool and sheath of claim 1, wherein the bit set storage includes a plurality of cavities and each cavity is structured and configured to store one or more bits from the plurality of bits.

7. The multi-tool and sheath of claim 1, wherein the sheath further includes a clip on an external portion of the frame.

8. The multi-tool and sheath of claim 7, wherein the clip is a MOLLE compatible belt clip.

9. The multi-tool and sheath of claim 1, wherein the frame is open on a first side and has walls on at least portions of a top, bottom, front, back, and second side.

10. The multi-tool and sheath of claim 9, wherein the walls on the front, top, and bottom are partial walls.

11. The multi-tool and sheath of claim 9, wherein the walls on the back and second side are complete walls.

12. The multi-tool and sheath of claim 1, wherein the multi-tool includes a plurality of tools that are pivotally connected to a frame of the multi-tool.

13. The multi-tool and sheath of claim 1, wherein the multi-tool includes at least one of a tap hammer on a side of a frame of the multi-tool and a bushing wrench inset into the frame of the multi-tool.

14. The multi-tool and sheath of claim 12, wherein the plurality of tools includes at least one of a blade, a bolt override, a takedown punch, a firing pin retaining pin puller, at least one bolt carrier scraper, a carrier scraper, and a firing pin scraper.

15. The multi-tool and sheath of claim 12, wherein the plurality of tools includes at least one of a knife blade, a plurality of hex keys, a pin punch, a carbon scraper, a metal file, a pick, nut wrenches, and a bottle opener.

16. A multi-tool and sheath comprising:
a multi-tool having a plurality of tools that are pivotally connected to a frame of the multi-tool; and
a sheath for storing the multi-tool, the sheath including
a frame,
a spring-loaded bit driver pivotally connected to the frame, and
a release lever structured and configured to engage with the spring-loaded bit driver in a first orientation to releasably contain the multi-tool in the sheath.

17. The multi-tool and sheath of claim 16, the sheath further comprising bit set storage, wherein the bit set storage is inset in the frame and is structured and configured to house a plurality of bits.

18. A method of using a sheath as a bit driver, the method comprising:
engaging a release lever on a frame of a sheath to release a spring-loaded bit driver,
wherein, prior to engagement of the release lever, a multi-tool is contained by the bit driver in the sheath, and wherein, after engagement of the release lever, the bit driver pivots away from the release lever and the frame acts as a handle for the bit driver;

removing the multi-tool from inside the frame of the sheath;

removing a bit from bit set storage that is inset in the frame of the sheath; and inserting the bit into the bit driver, wherein the bit driver magnetically engages the bit.

19. The method of claim 18, the method further comprising:

removing the bit from the bit driver;

securing the bit into the bit storage;

inserting the multi-tool into the frame of the sheath; and pivoting the bit driver toward the release lever and engaging a cavity of the bit driver with an engagement portion of the release lever.

20. The method of claim 18, wherein the bit set storage is magnetic.

* * * * *